United States Patent [19]

Shieh

[11] Patent Number: 4,498,878

[45] Date of Patent: Feb. 12, 1985

[54] SAFETY DIVING BACKPACK

[76] Inventor: Shin-Shi Shieh, 56-3, Kien Kwo N. Rd., Taipei, Taiwan

[21] Appl. No.: 413,283

[22] Filed: Aug. 31, 1982

[51] Int. Cl.[3] ..... B63B 21/52

[52] U.S. Cl. ..... 441/80; 114/315; 114/317; 114/336; 405/186; 116/26; 116/210

[58] Field of Search ..... 114/336, 315, 317; 441/80, 30, 92, 114; 116/26, 27, 210, 211; 128/201.27; 405/186, 185

[56] References Cited

U.S. PATENT DOCUMENTS

| | | | |
|---|---|---|---|
| 1,242,752 | 10/1917 | Youngren | 405/186 |
| 3,090,205 | 5/1963 | Hurwitz et al. | 405/186 |
| 3,760,440 | 9/1973 | Casciano | 441/30 |
| 3,939,510 | 2/1976 | Curd, Jr. | 441/28 |
| 4,155,132 | 5/1979 | Lee | 441/80 |

FOREIGN PATENT DOCUMENTS

| | | | |
|---|---|---|---|
| 2029332 | 3/1980 | United Kingdom | 441/92 |

*Primary Examiner*—Trygve M. Blix
*Assistant Examiner*—Patrick W. Young
*Attorney, Agent, or Firm*—Karl W. Flocks; Sheridan Neimark

[57] ABSTRACT

A safety diving backpack, specifically a one-piece, detachable diving backpack, that may serve to dispose water-resistant handlights, life buoys, kettles and spin reel, complete with wires or ropes in the hollow cylinder and in the spaces as provided on both sides and on the underside thereof respectively. The linkage as provided by such wire-ropes to fellow divers allows divers to ask for help from such fellow divers in case of an emergency that befalls a diver equipped accordingly. In addition, by virtue of the striking marks and alarm signals of the headlights and life buoys released at the outbreak of fatal tides or other dangerous situations to the diver, the rescue teams can detect them in time so as to give necessary help to the endangered diver.

4 Claims, 7 Drawing Figures

SAFETY DIVING BACKPACK

BACKGROUND OF THE INVENTION

The present invention provides for a novel, but simply structured and operated safety diving backpack that protects human lives by minimizing accidents to which the divers equipped therewith are exposed by sending out striking alarming marks and signals on the surface in a timely manner once a dangerous situation develops.

As leisure time recreation activities become more and more in fashion across the globe, many people seek diving pleasures underwater in seaside resorts or cliffy seashores within their easy reach, or where such beach waters are accessable to them at whatever costs they can afford. Diving activities have actually become a favorable pastime everywhere, but, regrettably, accidents in connection with diving activities have often occurred, somtimes with fatal results. The sudden development of a dangerous situation, allows little time to cope with it. A diver involved cannot react quickly enough to save his own life or assist his fellow diver. Such dangers can reasonably be accounted for by affected visionary faculties underwater, deceptively characterized underseas formations, together with abrupt, unpredictable and unexpected changes in temperatures, undercurrents, and atmospheric pressures underseas. The conventional and prevalent diving backpacks are almost all designed to serve to carry air cylinders only, with practically no other life-saving provisions whatever. Thus, they will be of little help if an unexpected incident should take place while they are worn on the back of a diver underseas.

SUMMARY OF THE INVENTION

The primary objective of the present invention, therefore, is to provide, in view of the shortcomings of existing diving backpacks such as those related to above, a novel diving backpack to secure the safety of a diver underseas anytime.

A further objective of the present invention is to provide a safety diving backpack characteristic in that a water kettle is provided attached to the hollow center of the backpack to provide drinking water for a diver equipped accordingly while he, having experienced an incident underwater or on the surface, is floating or drifting on the surface of the sea awaiting rescue. To stay alive, he may consume or remove the water from the kettle and leave it sealed, so that the kettle acts as a float overwater to attract the attention of the rescue teams.

Still another objective of the present invention is to provide a safety diving backpack, characteristic in that a hollow cylinder is provided on either side of the backpack, complete with a water-resistant alarming handlight and an inflatable emergency buoy painted with a colorful and eyecatching coating within, in order that, by virtue of the duplex alarm signals generated by the flashing handlight and the buoy, the rescuing vessles and aircraft will have a better chance of discovering the endangered divers. Also, on top of the hollow cylinder, there is a small space to place fishhooks so that if a diver waiting for help is hungry, he can link the fishhook to a rope and fish.

Still another objective of the present invention is to provide a safety diving backpack, characteristic in the provision of a spin reel, wound with nylon ropes, as attached to the bottom of the central encasement thereof, in order that divers that are active underseas in a group, will be able to link to each other with the nylon ropes to provide mutual assistance when the visibility underseas is poor. More specifically, as cavities and deep holes abound underseas, especially in locations close to the sea beds, the reel and rope allow divers to trace back to the surface with such life ropes as extended from a near-shore point or a floating boat or the like, thereby minimizing casualties during dives in the waters offshore.

DETAILED DESCRIPTION OF THE INVENTION

Figure 1:
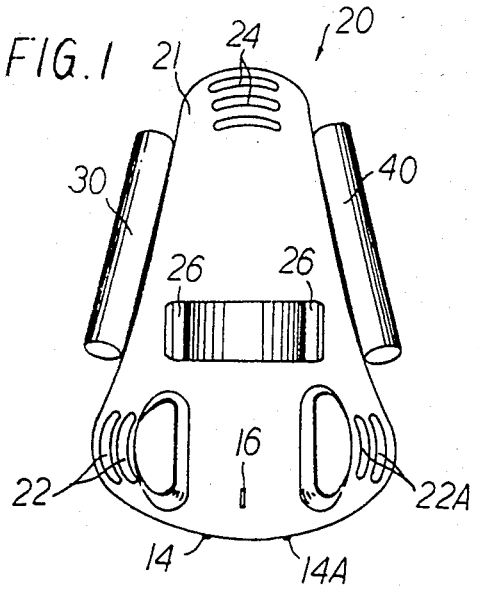
FIG. 1 is a frontal view of the safety diving backpack of the present invention.
Figure 3:
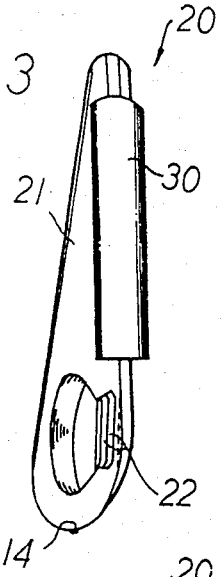
FIG. 3 is a left side view of the safety diving backpack.
Figure 4:
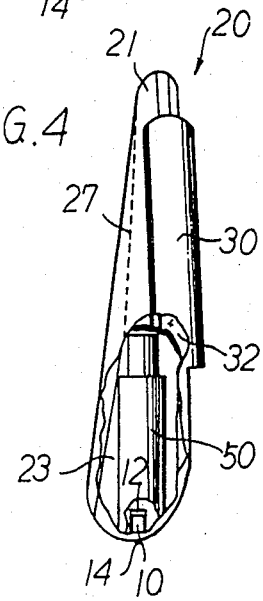
FIG. 4 is a left side perspective of the interior structure of the safety diving backpack.

Referring to FIG. 1, it is seen that the present invention of safety diving backpack 20 is chiefly composed of a one-piece backpack body 21, a cylindrical tube 30, 40 as attached to either side thereof, pack fastening ring hooks 24, 22, and 22A as provided on the upper neck and both sides on the under section thereof. The pack fastening ring hooks serve to accommodate passing of pack straps, not shown in the drawing, for fastening on the back of a diver before operating under water. On both ends of the midmost section of the backpack 21 there are provided two longitudinal groove ways 26 to facilitate passing of the fastening straps of the oxygen container, not shown in the drawing, the oxygen container being mounted in groove 27, as illustrated in FIG. 4 and FIG. 5.

Figure 2:
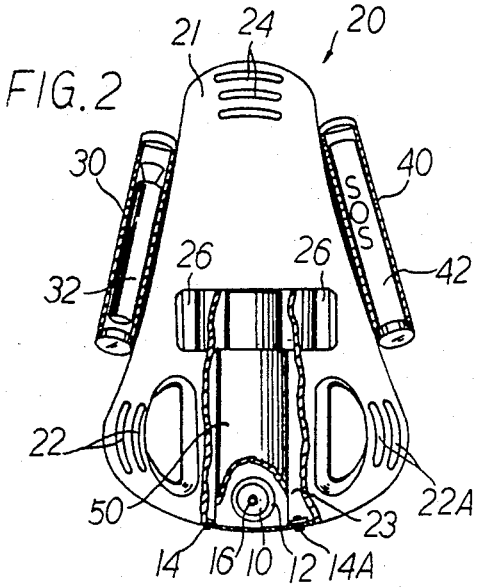
FIG. 2 is a frontal view of the interior of the safety diving backpack.
Figure 7:
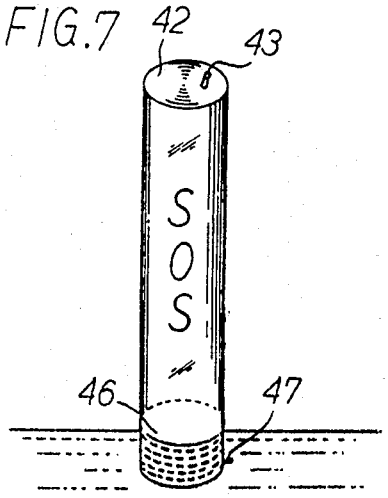
FIG. 7 is a three-dimensional view of the life buoy to be disposed in the safety diving backpack.

Referring to FIG. 2 and FIG. 7, it is seen that a water-resistant handlight 32 and life buoy 42 are contained in the hollow cylinder 30, 40 respectively; the watertight handlight 32 serves for underwater illumination or else serves to evince flashing emergency signals to advise the rescuing teams, vessels, and aircraft of the present position of endangered diver floating over the surface. The usefulness of such a watertight handlight becomes apparent at night or in bad weather conditions accompanied with poor visibility. The life buoy 42, as illustrated in FIG. 7, is a long, slim cylinder, with an air port 43 provided on top, to facilitate blowing to formation when needed. The buoy is stored deflated in the backpack. On the bottom of the buoy, there is provided a valve structure 47 to control the passing of water into the water layer 46. The gravity due to the water allowed into the water layer 46 serves to set the buoy 42, blown to formation, standing straight above the surface of the waters, in sufficient stability, as high as 2M clear of water. The characters of "SOS" are marked on the coating of the buoy in contrast to attention-drawing colors of the coating, for example, red, yellow or other colors, so that search and rescue teams, be they vessels or aircraft, will be able to spot the buoy from a remote position with ease. The top of either hollow cylinder 30, 40 is provided each with a watertight cock, not shown in the drawing, to facilitate use.

Figure 5:
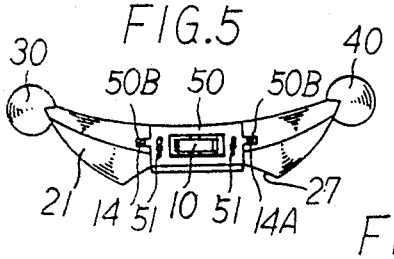
FIG. 5 is a bottom view of the safety diving backpack.
Figure 6:
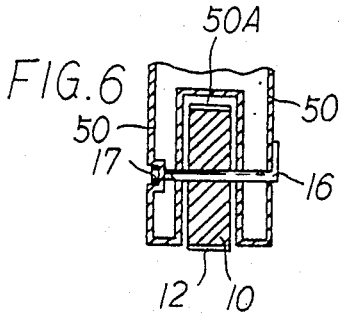
FIG. 6 is a profile view of the spin wheel as fixed inside the kettle that constitutes in part the safety diving backpack.

Referring to FIG. 2, FIG. 4, FIG. 5, and FIG. 6, on the underside of the backpack 21 there is provided a sunk-in, small chamber 23 to facilitate the introduction of a water kettle 50, which is then bolted into the pack by the interlocking of two lateral flanges 50B, complete with round grooves on top that are integrated to the kettle 50 with two locking screws 14, 14A against the counterpositioned thread holes as provided on the bottom of the backpack 21, not shown in the drawings. The bottom of the kettle 50 is complete with two access holes for tubes, secured by two cock caps 51, as shown in FIG. 5, which can be removed to supply water beforehand to maintain the life of the endangered diver for rescue while floating on the surface. Referring to FIG. 6, it is seen that a notched groove 50A is provided at the middle of the base of the kettle 50 so that a reel wheel 10 wound with nylon ropes 12 can be snapped in via the other terminal hole of the kettle 50 by means of an L-shaped retainer rod 16, thence piercing through a central hole groove, not shown in the drawing, as provided in the reel wheel 10 for extension to the other end of the kettle, and then fastened with a bolting screwnut 17. The idea is such that divers underwater may secure a firm link with each other by the connection of the nylon ropes 12 as provided in each backpack to be secured on the back of the respective divers concerned so as to take necessary assistance actions in case of incidents befalling any member of the diving team operating underwater.

The safety diving backpack 20 as covered by the present invention, is complete with safety devices such as the watertight handlight 32, the life buoy 40 and which altogether is easily portable. The bottom of them are all attached with nylon ropes, not shown in the drawing, linked to the hollow cylinders 30, 40, to avoid getting lost underwater due to carelessness or maladroitness on the part of the driver equipped accordingly. The life buoy, once blown to formation, serves to assist floating to help the diver reach the surface in time and discharge the help-soliciting effects. When on the surface, together with the diver, while an incident takes place, the kettle 50 can also be floated on the surface to add the help-soliciting effects. By reason of all these, the present invention is therefore believed to be a multifunction salvage safety diving backpack.

The present invention is a salvage equipment which has been proven to be of enormous help in case of any kind of emergency occurring underwater by the efficient dissemination of the emergency help-soliciting marks and signals to the search and rescue teams, thus minimizing casualties.

I claim:

1. A safety diving backpack, comprising a salvage backpack body, a watertight handlight, a life buoy, a water kettle and a reel wheel, the backpack body being formed in one piece complete with two hollow cylinders on both sides thereof serving to set in the handlight and the life buoy respectively, the center portion of the backpack projecting outwards to let in a water kettle and a reel wheel wound with nylon ropes that will all come to service in case of emergency, thereby providing means for sustaining the life of an endangered diver or for releasing emergency help-seeking signals for search and rescue teams or other vessels or aircrafts passing by; the water kettle being complete with two passage holes on the bottom to be covered with two kettle cocks to keep drinkable water as contained therein intact from sea waters, and being complete with fixing fins to facilitate fixing onto the counterpart hollow spaces as provided in the backpack body by means of screws.

2. The safety diving backpack according to claim 1, having an air port on top of the life buoy, to serve blowing into formation when an incident is happening or impending, and a water compartment and valve on the bottom thereof for the purpose of bringing in water to fill up the bottom compartment so that the life buoy may be provided with sufficient gravity to extend vertically on the surface to serve as a striking help-seeking object.

3. A safety diving backpack, comprising a salvage backpack body, a watertight handlight, a life buoy, a water kettle and a reel wheel, the backpack body being formed in one piece complete with two hollow cylinders on both sides thereof serving to set in the handlight and the life buoy respectively, the center portion of the backpack projecting outwards to let in a water kettle and a reel wheel wound with nylon ropes that will all come to service in case of emergency, thereby providing means for sustaining the life of an endangered diver or for releasing emergency help-seeking signals for search and rescue teams or other vessels or aircrafts passing by; the reel wheel thereof being fastened against a sunk-in groove as provided inside the water kettle by means of an L shape snap rod and tightening screwnuts.

4. The safety diving backpack according to claim 3, having an air port on top of the life buoy, to serve blowing into formation when an incident is happening or impending, and a water compartment and valve on the bottom thereof for the purpose of bringing in water to fill up the bottom compartment so that the life buoy may be provided with sufficient gravity to extend vertically on the surface to serve as a striking help-seeking object.

* * * * *